US010018939B2

(12) United States Patent
Shindo et al.

(10) Patent No.: US 10,018,939 B2
(45) Date of Patent: Jul. 10, 2018

(54) ELECTROPHOTOGRAPHIC OR ELECTROSTATIC RECORDING TYPE IMAGE FORMING APPARATUS

(71) Applicant: CANON KABUSHIKI KAISHA, Tokyo (JP)

(72) Inventors: Go Shindo, Mishima (JP); Norihito Naito, Numazu (JP); Masataka Mochizuki, Mishima (JP); Akihiko Uchiyama, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/433,784

(22) Filed: Feb. 15, 2017

(65) Prior Publication Data

US 2017/0235249 A1 Aug. 17, 2017

(30) Foreign Application Priority Data

Feb. 17, 2016 (JP) ..... 2016-028396
Jan. 13, 2017 (JP) ..... 2017-004659

(51) Int. Cl.
*G03G 15/08* (2006.01)
*G03G 15/00* (2006.01)

(52) U.S. Cl.
CPC ..... *G03G 15/0831* (2013.01); *G03G 15/0865* (2013.01); *G03G 15/5008* (2013.01); *G03G 15/5041* (2013.01); *G03G 15/5058* (2013.01)

(58) Field of Classification Search
CPC ..... G03G 15/0831; G03G 15/0865; G03G 15/5041; G03G 15/5058
USPC ..... 399/49
See application file for complete search history.

(56) References Cited

U.S. PATENT DOCUMENTS

2003/0091356 A1* 5/2003 Komatsu ..... G03G 15/5037 399/49
2006/0127133 A1* 6/2006 Suzuki ..... G03G 15/06 399/167

FOREIGN PATENT DOCUMENTS

| | | | |
|---|---|---|---|
| JP | 8-227222 A | | 9/1996 |
| JP | H09-050155 A | | 2/1997 |
| JP | H09-244390 A | | 9/1997 |
| JP | H09-311520 A | | 12/1997 |
| JP | 11-38750 A | | 2/1999 |
| JP | 2002-341604 A | | 11/2002 |
| JP | 2013-033293 | * | 2/2013 |
| JP | 2013-33293 A | | 2/2013 |
| JP | 2015-25997 A | | 2/2015 |

* cited by examiner

*Primary Examiner* — Sandra Brase
(74) *Attorney, Agent, or Firm* — Canon U.S.A., Inc. IP Division

(57) ABSTRACT

Changing of a peripheral speed ratio, resulting in change of the developer amount per unit area, enables the detection unit to detect the developer amount with sufficient accuracy.

9 Claims, 7 Drawing Sheets

ELECTROPHOTOGRAPHIC OR ELECTROSTATIC RECORDING TYPE IMAGE FORMING APPARATUS

BACKGROUND OF THE INVENTION

Field of the Invention

The present invention relates to an image forming apparatus of electrophotographic type or electrostatic recording type.

Description of the Related Art

An image forming apparatus of in-line color type including a plurality of image forming stations aligned along the rotational direction of an intermediate transfer member is known as an image forming apparatus such as a laser beam printer. Each of the image forming stations of such an image forming apparatus includes an image bearing member and develops an electrostatic latent image formed thereon by using a developing unit. Then, each image forming station primarily transfers a developed developer image from the image bearing member onto the intermediate transfer member. A plurality of the image forming stations repeats the same process to form a color developer image on the intermediate transfer member. Subsequently, the color developer image is secondarily transferred onto a recording material such as paper, and a fixing unit fixes the color developer image onto the recording material.

The image to be generated on the recording material in a series of image forming operations needs to be output satisfying the image and density desired by the user. Color reproducibility and stability are required for a full color image (color developer image) generated by a plurality of the image forming stations.

Japanese Patent Application Laid-Open No. 11-38750 discusses a technique for forming a plurality of patches on a photosensitive drum serving as an image bearing member while the rotational speed of a developing sleeve is varied, detecting a patch having reached a required density out of a plurality of the patches, and determining the rotational speed of the developing sleeve.

Japanese Patent Application Laid-Open No. 8-227222 discusses a technique for changing a developing bias and changing the rotational speed of a developer bearing member such as a development roller to extend a color selection range.

The invention discussed in Japanese Patent Application Laid-Open No. 8-227222 is configured to increase the amount of developer supplied from the developer bearing member such as the developing roller to an image bearing member such as a photosensitive member to extend the color selection range.

In a case where the color selection range is extended by increasing the developer amount per unit area on such an image bearing member, a detection unit for detecting the developer amount is unable to detect the developer amount with sufficient accuracy in some cases.

SUMMARY OF THE INVENTION

According to an aspect of the present invention, an image forming apparatus operable in an image forming mode or in a detection mode, the image forming apparatus includes an image bearing member configured to bear a developer image, a developer bearing member configured to bear developer, and a detection unit configured to detect a developer amount on the image bearing member. In the image forming mode, the developer image is formed on the image bearing member by supply of developer to be borne by the developer bearing member to the image bearing member. In the detection mode, a detection developer image used for detection is formed on the image bearing member and a developer amount of the detection developer image is detected by the detection unit. In a case where a peripheral speed ratio (v11/v12) between a peripheral speed (v11) of the developer bearing member and a peripheral speed (v12) of the image bearing member in the detection mode is denoted by $\Delta v1$, and a peripheral speed ratio (v21/v22) between a peripheral speed (v21) of the developer bearing member and a peripheral speed (v22) of the image bearing member in the image forming mode is denoted by $\Delta v2$, in a state of $\Delta v1<\Delta v2$, a developer amount on the image bearing member in the image forming mode is estimated based on a result of a detection of a developer amount on the image bearing member in the detection mode.

According to another aspect of the present invention, an image forming apparatus operable in an image forming mode or in a detection mode, the image forming apparatus includes an image bearing member configured to bear a developer image, an intermediate transfer member on which the developer image on the image bearing member is transferred, a developer bearing member configured to bear developer, a detection unit configured to detect a developer amount on the intermediate transfer member. In the image forming mode, the developer image is formed on the intermediate transfer member by transfer of developer to be supplied from the developer bearing member to the image bearing member onto the intermediate transfer member. In the detection mode, a detection developer image used for detection is formed on the image bearing member, and a developer amount of the detection developer image is detected by the detection unit. In a case where a peripheral speed ratio (v11/v12) between a peripheral speed (v11) of the developer bearing member and a peripheral speed (v12) of the image bearing member in the detection mode is denoted by $\Delta v1$, and a peripheral speed ratio (v21/v22) between a peripheral speed (v21) of the developer bearing member and a peripheral speed (v22) of the image bearing member in the image forming mode is denoted by $\Delta v2$, in a state of $\Delta v1<\Delta v2$, a developer amount on the intermediate transfer member in the image forming mode is estimated based on a result of a detection of a developer amount on the image bearing member in the detection mode.

Further features of the present invention will become apparent from the following description of exemplary embodiments with reference to the attached drawings.

DESCRIPTION OF THE EMBODIMENTS

Figure 1:
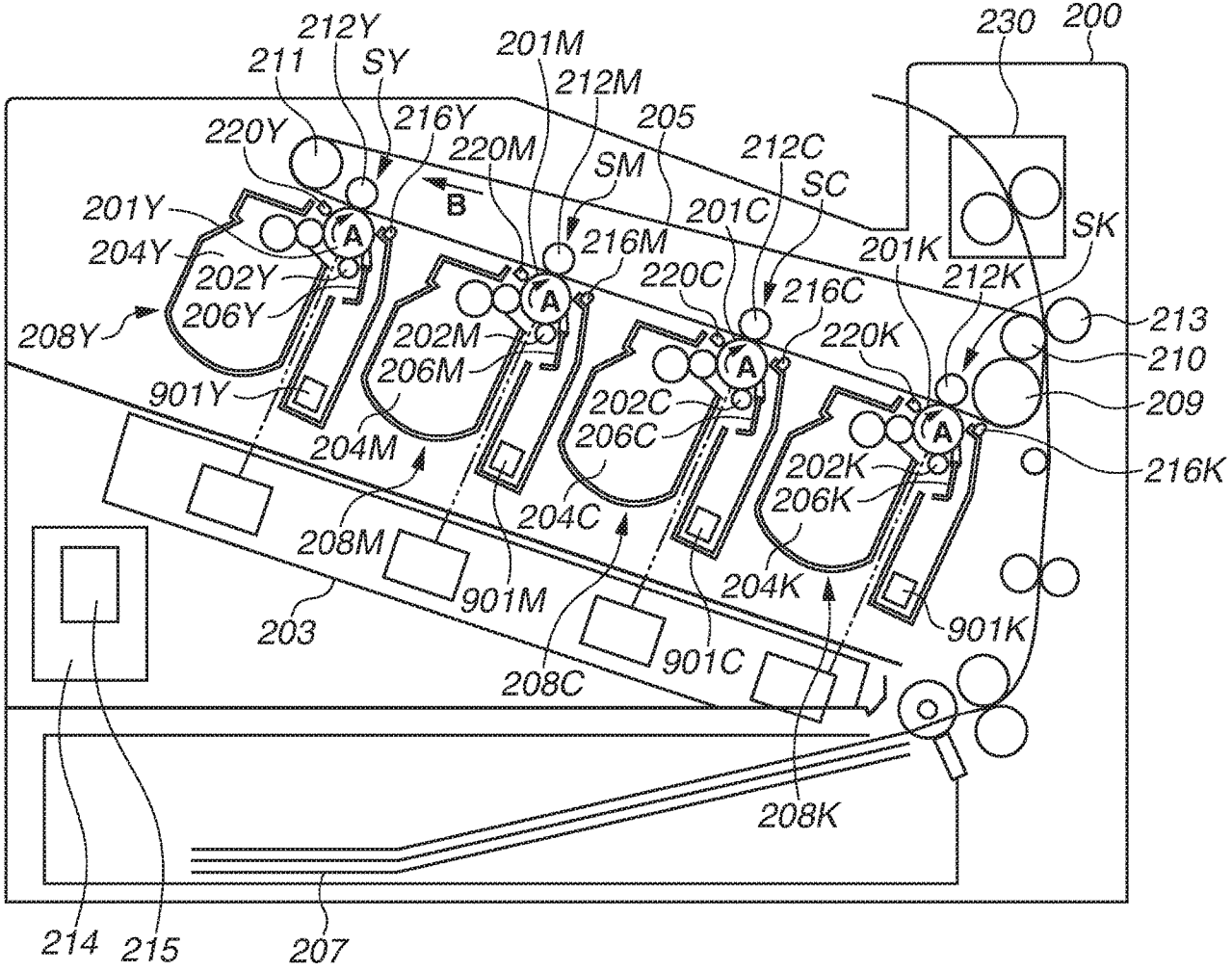
FIG. 1 is a schematic view illustrating an image forming apparatus according to a first exemplary embodiment.

Exemplarily embodiments for embodying the present invention will be described in detail below with reference to the accompanying drawings. However, sizes, materials, shapes, and relative arrangements of elements described in the exemplary embodiments are not limited thereto, and should be modified as required depending on the configuration of an apparatus according to the present invention and other various conditions. The scope of the present invention is not limited to the exemplary embodiments described below.

The following terms will be used in the present specification.

An image forming apparatus refers to an apparatus for forming an image on a recording material.

A process cartridge refers to a cartridge including at least an image bearing member. In many cases, a process cartridge refers to a cartridge which integrates a charging unit, a developing unit, a cleaning unit, and an image bearing member, and is attachable to and detachable from the main body of the image forming apparatus.

A developing apparatus refers to an apparatus including at least a developer bearing member. In many cases, a developing apparatus refers to an apparatus which integrates a developer bearing member, a development frame for supporting the developer bearing member, and related parts, and is attachable to and detachable from the main body of the image forming apparatus.

The main body of the image forming apparatus refers to component members of the apparatus excluding at least process cartridges from the configuration of the image forming apparatus. The developing apparatus as a single unit may be configured to be attachable to and detachable from the main body of the apparatus. In such a case, the main body of the apparatus refers to component members of the apparatus excluding the developing apparatus from the configuration of the image forming apparatus.

A first exemplary embodiment of the present invention will be described below. The present exemplary embodiment will be described in detail below centering on a case where a developer amount (weight of developer per unit area) on an image bearing member is predicted and detected with sufficient accuracy by using an optical sensor unit of normal reflection type as a detection unit. In particular, it is possible to predict and detect the developer amount with sufficient accuracy even in a case of image formation where a plurality of layers of toner as developer is formed on the photosensitive drum as an image bearing member.

In the present exemplary embodiment, the image forming apparatus has a detection mode for detecting a developer image (for example, a toner image) that is formed on an image bearing member (for example, a photosensitive drum) and that is used for a developer amount detection by the detection unit.

In the present exemplary embodiment, the image forming apparatus predicts the toner amount as the developer amount on the photosensitive drum at the time of image formation. The peripheral speed ratio between the developing roller and the photosensitive drum refers to the ratio of the moving speed of the developing roller to the moving speed of the photosensitive drum. To predict the toner amount, the peripheral speed ratio in the detection mode is made smaller than the peripheral speed ratio at the time of image formation. In the present exemplary embodiment, the moving speed of the developing roller is decreased with the moving speed of the photosensitive drum remaining unchanged, to decrease the peripheral speed ratio. The moving speed, for example, refers to the speed at which the surface of the developing roller moves. According to the present exemplary embodiment, the moving speed refers to the moving speed at which the outer surface of the developing roller rotates centering on the rotation axis.

The optical sensor unit serving as a detection unit detects the toner amount per unit area on the photosensitive drum with reduced peripheral speed ratio. In the detection mode, since the peripheral speed ratio is reduced, the toner amount per unit area on the photosensitive drum is smaller than the toner amount per unit area on the photosensitive drum at the time of image formation. Accordingly, the image forming apparatus compares [1] the peripheral speed ratio in the image forming mode at the time of image formation with [2] the peripheral speed ratio in the detection mode, and [3] predicts the toner amount per unit area on the photosensitive drum at the time of image formation, based on the toner amount per unit area on the photosensitive drum in the detection mode. The peripheral speed ratio is controlled so that the toner amount per unit area on the photosensitive drum in the detection mode falls within a range of the toner amount per unit area detectable by the detection unit with sufficient accuracy. This configuration enables detection of the toner amount with higher accuracy than that in the direct measurement of the toner amount per unit area at the time of image formation.

The detection mode is executed when power of the image forming apparatus is turned ON or at a suitable timing at which image forming conditions should be reviewed. Various setting conditions can be changed in a required range using information about the toner amount per unit area on the photosensitive drum obtained in the detection mode. For example, based on the information about the toner amount per unit area on the photosensitive drum, a toner amount on paper can be calculated and a fixing temperature can be changed, an image processing for color matching can be utilized, and a toner amount per unit area on the developing roller can be predicated. Hereinafter, the detection mode for detecting the toner amount on the photosensitive drum is simply referred to as a detection mode.

In the present exemplary embodiment, the detection unit detected the toner amount per unit area on the photosensitive drum. Alternatively, the detection unit may detect the toner amount per unit area transferred onto an intermediate transfer member (described below).

A process cartridge and an image forming apparatus according to the present exemplary embodiment will be described in detail below. FIG. 1 is a sectional view schematically illustrating an image forming apparatus 200 according to the present exemplary embodiment. The image forming apparatus 200 according to the present exemplary embodiment is a full color laser beam printer which employs the in-line method and the intermediate transfer method. The image forming apparatus 200 is capable of forming a full color image on a recording material (for example, recording paper) according to image information. As the image information, a signal is transmitted from a host apparatus (not illustrated) such as a personal computer communicably connected to an image reading apparatus or image forming apparatus connected to the image forming apparatus 200.

The transmitted signal is input to a central processing unit (CPU) 215 serving as a control unit included in an engine controller 214 in the image forming apparatus 200.

The image forming apparatus 200 includes a plurality of image forming units: a first image forming unit SY, a second image forming unit SM, a third image forming unit SC, and a fourth image forming unit SK for forming images of four different colors, yellow (Y) magenta (M), cyan (C), and black (K), respectively. Each image forming unit includes a process cartridge 208 and a primary transfer roller 212 disposed to face the process cartridge 208 via an intermediate transfer belt 205. According to the present exemplary embodiment, the first to the fourth image forming units SY, SM, SC, and SK are aligned along a direction intersecting with the vertical direction (in a direction oblique to the horizontal direction). According to the present exemplary embodiment, the configurations and operations of the first to the four image forming units are substantially the same except that they form images of different colors. Thus, hereinafter, unless distinction is particularly required, each image forming apparatus will be collectively described below without using subscripts Y, M, C, and K which have been supplied to represent respective colors. However, the shape, configuration, and operation of each image forming unit may be different depending on the configuration. For example, the capacity of black toner may be increased. In such a case, the outside dimension of the process cartridge for black becomes larger than the other process cartridges, and, as a result, the image forming unit for black becomes large in size.

The image forming apparatus 200 according to the present exemplary embodiment includes four drum-shaped electrophotographic photosensitive members (hereinafter referred to as photosensitive drums 201) aligned along a direction intersecting with the vertical direction (in a direction oblique to the horizontal direction), as illustrated in FIG. 1. When a gear serving as a drive force transfer unit receives from a drive unit (drive source) a drive force in the direction illustrated by the arrow A (clockwise direction), the drive force is transmitted to a photosensitive drum 201 to rotatably drive it. The drive unit can be controlled within a required range for the rotation drive speed (moving speed) of the photosensitive drum 201. Around the photosensitive drum 201, a charging roller 202 serving as a charging unit for uniformly charging the surface of the photosensitive drum 201 is disposed. A scanner unit (exposure apparatus) 203 serving as an exposure unit for irradiating the photosensitive drum 201 with laser light based on image information to form an electrostatic image (electrostatic latent image) thereon is disposed. Around the photosensitive drum 201, a developing unit (developing apparatus) 204 for developing an electrostatic image as a toner image, and an optical sensor unit 220 as a detection unit for detecting the toner amount on the photosensitive drum 201 are disposed. Further, a cleaning member (cleaning blade) 206 as a cleaning unit for removing toner (residual transfer toner) remaining on the surface of the photosensitive drum 201 after transfer, and a pre-exposure light emitting diode (LED) 216 for destaticizing the potential on the photosensitive drum 201 are disposed. Further, facing the four photosensitive drums 201, the intermediate transfer belt 205 serving as an intermediate transfer member for transferring toner images formed on the photosensitive drums 201 onto a recording material 207 is disposed. The process cartridge 208 includes the photosensitive drum 201, the charging roller 202 serving as a process unit for the photosensitive drum 201, a developing unit 204, and the cleaning member (cleaning blade) 206 integrally formed. The process cartridge 208 is attachable to and detachable from the image forming apparatus 200. According to the present exemplary embodiment, all of the process cartridges 208 for four colors have the same shape, and store toner of respective colors, yellow (Y), magenta (M), cyan (C), and black (K). According to the present exemplary embodiment, toner having the negative charging characteristics as developer will be described below. However, depending on a configuration, positive charging characteristics is applicable, and magnetic and non-magnetic toner are also applicable. A two-component developer is also applicable depending on a configuration.

The intermediate transfer belt 205 formed of an endless belt serving as an intermediate transfer member is in contact with all of the photosensitive drums 201, and rotates in the direction illustrated by the arrow B (counterclockwise direction). The intermediate transfer belt 205 lies across a plurality of supporting members: a drive roller 209, a secondary transfer counter roller 210, and a driven roller 211. On the inner circumferential side of the intermediate transfer belt 205, four primary transfer rollers 212 serving as primary transfer units are aligned to face the corresponding photosensitive drums 201. A bias having the opposite polarity (positive polarity in the present exemplary embodiment) to the normal charging polarity of toner (negative polarity in the present exemplary embodiment as described above) is applied to the respective primary transfer rollers 212 from a primary transfer bias power source (not illustrated). This bias transfers toner images on the photosensitive drums 201 onto the intermediate transfer belt 205. On the outer circumferential side of the intermediate transfer belt 205, a secondary transfer roller 213 as a secondary transfer unit is disposed at a position facing the secondary transfer counter roller 210. A bias having the opposite polarity to the normal charging polarity of toner is applied to the secondary transfer roller 213 from a secondary transfer bias power source (not illustrated). This bias transfers a toner image on the intermediate transfer belt 205 onto the recording material 207. The recording material 207 with the toner image transferred thereon passes through the fixing unit 230 to be subjected to thermal fixing and then is discharged to the outside of the apparatus. Thus, a final print (the recording material 207 with the toner image printed thereon) is obtained.

Although, in the present exemplary embodiment, the primary transfer roller 212 is disposed in each image forming unit, the four primary transfer rollers 212 may be replaced with one common primary transfer roller 212. Further, the primary transfer rollers 212 themselves may be removed. In this case, the toner images are transferred by a potential difference produced on the surface of the photosensitive drums 201 facing the surface of the intermediate transfer member by using a current from the secondary transfer roller 213.

Figure 2:
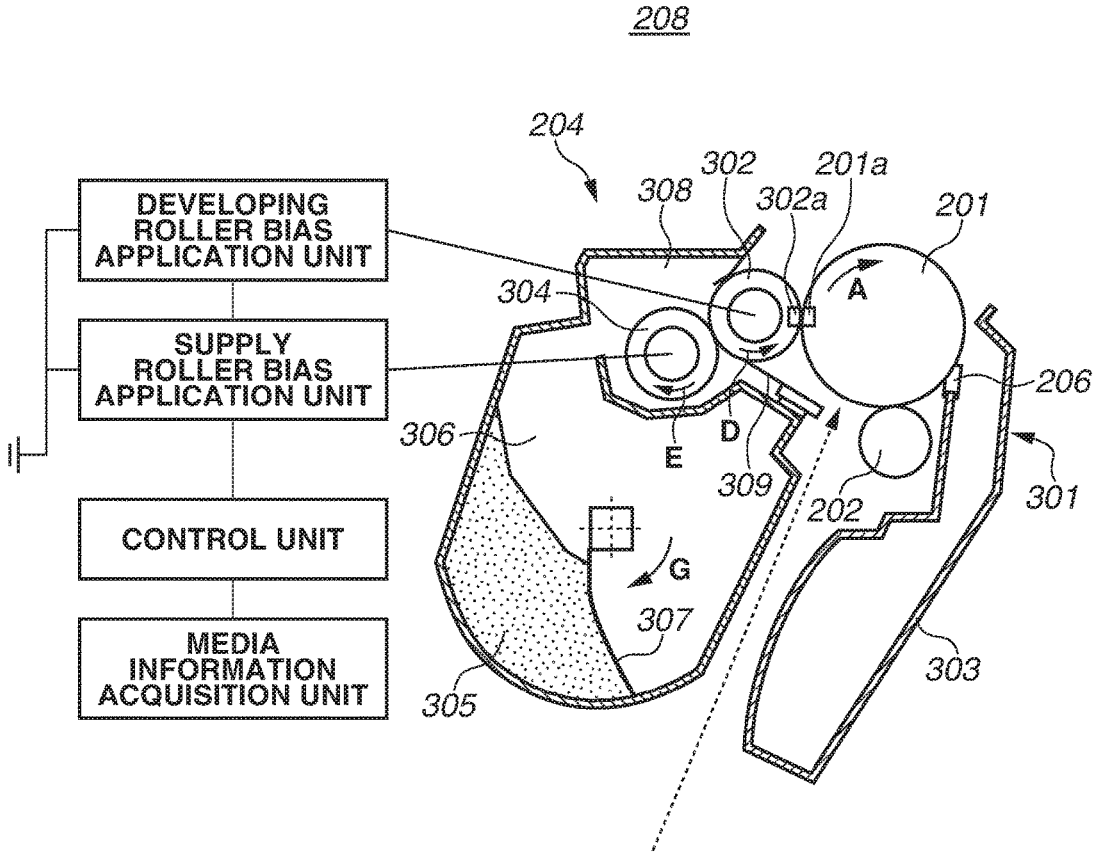
FIG. 2 is a schematic view illustrating a process cartridge according to the first exemplary embodiment and a second exemplary embodiment.

The overall configuration of the process cartridge 208 to be attached to the image forming apparatus 200 according to the present exemplary embodiment will be described below with reference to FIG. 2. FIG. 2 is a sectional view schematically illustrating the process cartridge 208 according to the present exemplary embodiment when viewed from the longitudinal direction of the photosensitive drum 201 (the direction of the rotational axis line). According to the present exemplary embodiment, the configurations and operations of the process cartridges 208 for each color are identical except for the type (color) of the developer stored therein. The process cartridge 208 includes a photosensitive unit 301 including the photosensitive drum 201 and the developing unit 204 including a developing roller 302. The photosensitive unit 301 includes a cleaning frame 303 serving as a frame for supporting various elements in the photosensitive unit 301. The photosensitive drum 201 is rotatably attached to the cleaning frame 303 via a bearing (not illustrated). When the drive force of a drive motor as a drive unit (drive source) (not illustrated) is transmitted to a gear provided in the photosensitive unit 301, the photosensitive drum 201 is rotatably driven in the direction indicated by the arrow A (clockwise direction) according to the image forming operation. The photosensitive drum 201 serving as a center of the image forming process employs an organic photoreceptor including an aluminum cylinder with an undercoat layer as a functional film, a carrier generating layer, and a carrier transfer layer coated on the surface thereof in this order. The photosensitive unit 301 includes the cleaning member 206 and the charging roller 202 disposed in contact with the circumferential surface of the photosensitive drum 201. Residual transfer toner removed from the surface of the photosensitive drum 201 by the cleaning member 206 falls and is stored in the cleaning frame 303.

When a conductive rubber roller portion of the charging roller 202 serving as a charging unit is in pressure contact with the photosensitive drum 201, the charging roller 202 is rotatably driven. In the charging process, a predetermined direct-current (DC) voltage with respect to the photosensitive drum 201 is applied to the metal core of the charging roller 202. Thus, a uniform dark portion potential (Vd) is formed on the surface of the photosensitive drum 201. The photosensitive drum 201 is exposed to laser light emitted corresponding to image data by the above-described scanner unit 203. Electric charges on the surface of the exposed photosensitive drum 201 disappear by carriers from the carrier generating layer, and the potential drops. As a result, an electrostatic latent image (electrostatic image) is formed on the photosensitive drum 201 where exposed portions are set to a predetermined light portion potential (Vl) and unexposed portions are set to a predetermined dark portion potential (Vd). The developing unit 204 includes the developing roller 302 (rotating in the direction of the arrow D) as a developer bearing member, a developing blade 309 as a regulation member, a toner supply roller 304 (rotating in the direction of the arrow E) as a developer supply member, and toner 305 as a developer. The developing unit 204 further includes a stirring member 307 which also serves as a member for conveying the toner 305 and a toner container 306 for storing the toner 305. The toner 305 moves in the toner container 306 by the motion of the stirring member 307 (rotating in the direction of the arrow G) and part of toner is conveyed from the toner container 306 to a developing chamber 308. The rotation drive speed of the developing roller 302 can be controlled within a required range. According to the present exemplary embodiment, a predetermined developing bias Vdc (developing voltage or developing potential) is applied to the developing roller 302. When a bias (voltage) is applied to the developing roller 302, toner is transferred only to portions of a light portion potential by the potential difference at developing portions 201*a* and 302*a* where the photosensitive drum 201 and the developing roller 302 contact with each other, and the electrostatic latent image on the photosensitive drum 201 is visualized, thus forming a toner image.

The optical sensor unit (hereinafter referred to as an optical sensor) 220 serving as a detection unit for detecting a toner amount on the photosensitive drum 201 will be described below with reference to FIG. 3. The optical sensor 220 includes a light emission system including a LED 221 for irradiating a detection toner patch with light, and a light reception system for forming an image with an optical spot diameter of 0.8 mm on the photosensitive drum 201 by using a lens (not illustrated), a pinhole (not illustrated), and a photodiode 222. According to the present exemplary embodiment, the photosensitive drum 201 is irradiated with light through the lens, and the photodiode 222 as a light receiving element receives the amount of normal reflection light from the detection toner patch (toner image) which passes this portion, and the toner amount is detected based on the received light amount. FIG. 4 illustrates a relation between the toner weight per unit area (kg/m$^2$) on the photosensitive drum 201 and the detected signal output in a case where the optical sensor 220 of normal reflection type is used. The absolute value of the output signal for the background portion in the case of the absence of toner (surface of the image bearing member with no toner present) changes with the attachment accuracy of the optical sensor 220 and the surface property of the image bearing member such as the photosensitive drum 201. Accordingly, using a value obtained by dividing the output signal in a case where toner of a plurality of layers is present by the output signal of the background portion and then performing normalization enables detection of the toner density (toner weight) with sufficient accuracy irrespective of these disturbance factors. Since the output signal changes with the attachment accuracy of the optical sensor 220 and the surface property of the image bearing member, it is not necessary to perform output signal correction for the detection unit itself such as the optical sensor 220 each time the detection mode is set. In many cases, it is sufficient to perform output signal correction on the detection unit once at a suitable timing such as before the first image formation for a new cartridge (before first development). The signal detected by the detection unit before the first image formation is performed after a new process cartridge is attached to the image forming apparatus may be used as a correction value for the signal to be detected by the detection unit in the detection mode. The control unit may correct the detection signal of the detection unit in the detection mode for the process cartridge before performing the first image forming operation after a process cartridge is attached to the main body of the image forming apparatus. More specifically, the detection signal may be corrected, for example, when an instruction to correct the density is input or the high density mode is selected by the user.

With the optical sensor 220 of normal reflection type used in the present exemplary embodiment and a comparative example, the detection accuracy obtained with varying toner weight per unit area (kg/m$^2$) on the photosensitive drum 201 is illustrated in Table 1. We determined the detection accuracy within or out of the practical range by determining whether the difference in weight between [1] the result of the detection of the toner weight per unit area (kg/m$^2$) and [2] the result of the actual weight measurement (kg/m$^2$) falls within 0.0005 or less. To make this determination, we determined whether it is possible to distinguish the toner weight per unit area with which the fixing temperature should be changed for the secondary color of toner on the recording material 207 according to the present exemplary embodiment and the comparative example.

TABLE 1

| Toner amount on photosensitive drum 201 and detection accuracy of optical sensor | | | |
|---|---|---|---|
| | Toner weight per unit area ($kg/m^2$) | | |
| | 0 to 0.0030 | 0.0030 to 0.0045 | 0.0045 or above |
| Detection accuracy | A | B | C |

A: Good
B: Lower than A, within practical range
C: Out of practical range

Through the observation using an optical microscope, we found that one toner layer was formed on the photosensitive drum 201 in a case where the toner weight per unit area was 0 to 0.0030 ($kg/m^2$). Through similar observations, we found that a plurality of toner layers was formed on the photosensitive drum 201 in a case where the toner weight per unit area was 0.0045 ($kg/m^2$) or above. The optical sensor 220 of normal reflection type detects the toner amount based on decrease in the light amount resulting from specular reflected light from the target surface being hidden by toner. Accordingly, the optical sensor 220 provides high detection accuracy for approximately one toner layer, enables approximative detection for one to two toner layers, and may enable detection depending on the toner layer density for three toner layers. However, the optical sensor 220 provides low detection accuracy for four or more toner layers. The reason why approximately one toner layer is used instead of one toner layer is that, spaces between toner particles are filled even when toner is applied a little bit above one toner layer. This reduces specular reflected light from the target surface, providing detection accuracy in a favorable range.

The toner weight per unit area which provides a range of high detection accuracy will be described below. Assume that the maximum toner weight per unit area corresponding to one toner layer is denoted by M ($kg/m^2$), the average radius of toner is denoted by R (m), the specific gravity of toner is denoted by ρ ($kg/m^3$), and a planar closest-packing area ratio is denoted by H. The planar closest-packing area ratio H refers to a ratio of the maximum projection area that can be disposed in one toner layer on a certain plane to the area of the plane on the premise that all toner particles are spheres having the same size. The sphere arrangement is referred to as hexagonal packing arrangement, and the area ratio H equals n/12 (≈0.9069). When toner is assumed to be a collection of particles each having an average radius, Maximum number of toner particles that can be packed in unit plane is equal to $H/(\pi R^2)$. More specifically, in the case of one toner layer, the theoretical maximum toner weight per unit area is defined by the following formula: M=(Volume of toner)×ρ×(Maximum number of toner particles that can be packed in unit plane)=$(4/3\times\pi R^3)\times\rho\times(H/(\pi R^2))=4/3\times R\times\rho\times H$. Practically, since toner has a distribution of radius, the packing area ratio on a plane is smaller than the planar closest-packing area ratio H. Accordingly, it is expected that the toner weight per unit area for one or less toner layer is smaller than 4/3×R×ρ×H. As a result of actual examination, we detected the toner amount with high accuracy at least in a case where the toner weight per unit area was 4/3×R×ρ×H or below. Thus, we found that the toner amount can be detected with high accuracy for one or less toner layer. Further, we found that, since the packing area ratio on an actual toner plane is smaller than the planar closest-packing area ratio H, high accuracy detection was possible in a certain range even in a case where more than one toner layer can be formed. Thus, the following formula is obtained: (Toner weight per unit area with which high detection accuracy is possible)≤4/3×R×ρ×H. According to the present exemplary embodiment, 4/3×R×ρ×H is equal to 0.00302. According to the present exemplary embodiment, the average radius was 2.5 um ($2.5\times10^{-6}$ [m]) and the specific gravity was $1\times10^3$ ($kg/m^3$). The average particle diameter was measured by using the Multisizer 3 from BECKMAN COULTER, and the specific gravity was measured by using a true density meter.

Although image formation is performed in the above-described configuration, the toner amount to be developed may be fluctuated by potential variations. In a case where the toner amount is fluctuated, an image having density unevenness or color unevenness arises in some cases. To that end, in the present exemplary embodiment, a sufficient latent image electric field is generated with respect to the charge amount of toner given electric charges formed on the developing roller 302, so that, in a high density image pattern such as a solid black image, all (or almost all) the toner is developed from the developing roller 302 onto the photosensitive drum 201, in other words, "100% development setting" is employed. As a result, almost no toner remains on the developing roller 302 after development. Forming a sufficient latent image can provide a developed image as a stable toner image even in a case where the development property varies because of such factors as potential fluctuations.

With recent color laser beam printers (LBPs), the increase in the image density, the expansion of the color selection range, and the increase in the number of colors are demanded to obtain a variety of images. To achieve this, there has been proposed a technique for increasing the toner amount to be developed by changing the peripheral speed ratio between a photosensitive drum and a developing roller to increase the density and the number of colors in addition to a mode for obtaining a general image density. The peripheral speed ratio is controlled by a signal from a CPU serving as a control unit. Hereinafter, a mode in which the toner amount, per unit area, to be developed is increased compared with that in normal image formation (normal image forming mode) by changing the peripheral speed ratio between the photosensitive drum 201 and the developing roller 302 is referred to as a "high density mode". The high density mode is also a image forming mode. Here, the peripheral speed ratio is defined as follows: (Peripheral speed ratio between photosensitive drum and developing roller [%])={(Rotational speed of developing roller surface)/(Rotational speed of photosensitive drum surface)})×100 [%]. Hereinafter, the peripheral speed ratio between the photosensitive drum 201 and the developing roller 302 is simply referred to as a "peripheral speed ratio".

However, we found that the detection accuracy may degrade in a case where toner amount detection was performed in the high density mode. Accordingly, we performed an intensive examination, and found a detection method for detecting the toner amount with sufficient accuracy even with an image forming apparatus for performing image formation in the high density mode (constituting the "image forming mode" according to the present invention). This detection method will be described below.

The detection method includes predicting (estimating) the toner amount per unit area on the photosensitive drum 201 in the high density mode (image forming mode) by using a result in the detection mode (constituting the "detection mode" according to the present invention) for detecting the toner amount on the photosensitive drum 201.

In the present exemplary embodiment, the image forming mode and the detection mode are executed by the control unit.

Figure 5:
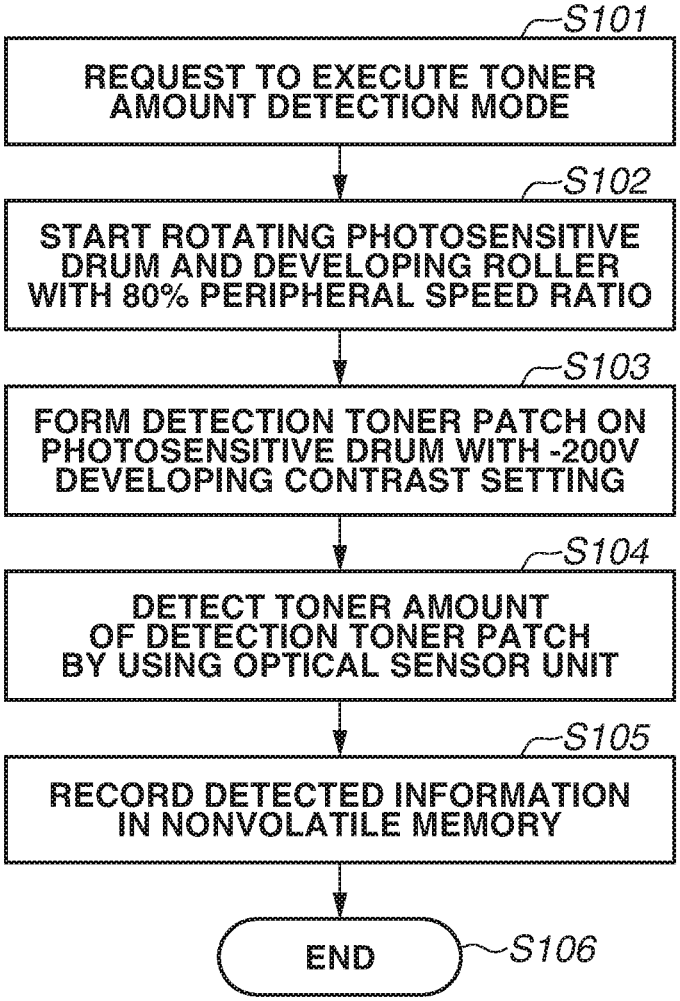
FIG. 5 is a flowchart illustrating a detection mode for detecting the toner amount on a photosensitive drum according to the first exemplary embodiment.

Operations in the detection mode will be described below with reference to FIG. 5. In step S101, in a case where a request for executing the detection mode is issued from the engine controller 214, the detection mode is executed. In step S102, in the detection mode, the control unit starts rotating the photosensitive drum 201 and the developing roller 302 with the 80% peripheral speed ratio. In the present exemplary embodiment, the peripheral speed ratio is set by changing the rotational speed of the developing roller 302 while the rotational speed of the photosensitive drum 201 is maintained equal to the rotational speed at the time of normal image formation (in the non-high density mode), i.e., while leaving unchanged the rotational speed of the photosensitive drum 201. The peripheral speed ratio, developing bias, and latent image settings in the detection mode will be described in detail below. The peripheral speed ratio in the detection mode is 80% which is smaller than values at the time of normal image formation (in the non-high density mode) and in the high density mode. For example, in a case where the peripheral speed ratio at the time of normal image formation is set to 150% and the peripheral speed ratio in the high density mode is set to 250% ($\Delta v2$), the peripheral speed ratio in the detection mode is 80% ($\Delta v1$) which is smaller than the values in the non-high and the high density modes. In other words, a relation $\Delta v1<\Delta v2$ is satisfied. Conceptually, the peripheral speed ratio between the developer bearing member and the image bearing member in the detection mode (the moving speed of the above-described developer bearing member divided by the moving speed of the above-described image bearing member) is denoted by $\Delta v1$.

According to the present exemplary embodiment, the toner amount per unit area on the photosensitive drum 201 at the time of normal image formation is set to 0.0028 ($kg/m^2$). As described above, since it is necessary to make the toner amount per unit area on the photosensitive drum 201 equal to or smaller than $4/3\times R\times\rho\times H=0.00302$, the peripheral speed ratio was set to 80% in the present exemplary embodiment. In a case where the peripheral speed ratio is denoted by $\Delta v$ and the toner amount per unit area on the developing roller 302 is G ($kg/m^2$), the peripheral speed ratio needs to satisfy a condition $\Delta v\leq(4/3\times R\times\rho\times H)/G$. Thus, in a case where the peripheral speed ratio in the detection mode is denoted by $\Delta v1$, a condition $\Delta v1\leq(4/3\times R\times\rho\times H)/G$ is satisfied. In other words, $\Delta v1$ is set so that the toner amount per unit area on the photosensitive drum 201 theoretically corresponds to one or less toner layer. As for the minimum value of the peripheral speed ratio, it is necessary that the peripheral speed ratio is equal to or larger than the value corresponding to the toner amount per unit area on the photosensitive drum 201 which is equal to or larger than the minimum amount detectable by the optical sensor unit 220. According to the present exemplary embodiment, the peripheral speed ratio at the time of normal printing is set to 150%, and the peripheral speed ratio in the high density mode is set to 250%. In the high density mode, in a case where the peripheral speed ratio is denoted by $\Delta v2$, a relation $\Delta v2>(4/3\times R\times\rho\times H)/G$ is satisfied. The development contrast in the detection mode is set to −200V. The development contrast refers to (Developing bias Vdc)−(Light portion potential Vl on the photosensitive drum 201), and means the potential difference required for toner to develop from the developing roller 302 onto the photosensitive drum 201. In the detection mode, almost all of solid black toner portions are set to be developed from the developing roller 302 onto the photosensitive drum 201. The development contrast is set to −200V at the time of normal printing and set to −350V in the high density mode. As in the detection mode, almost all the toner is set to be developed onto the photosensitive drum 201.

Conditions for almost all the toner to be developed onto the photosensitive drum 201 will be described below. Toner on the developing roller 302 is developed onto the photosensitive drum 201 by the development contrast at a developing NIP portion formed by the electrostatic latent image formed on the photosensitive drum 201 and the developing bias applied to the developing roller 302. The toner amount developable by the development contrast is determined by the product of the capacitance (C) of the photosensitive drum 201 and the development contrast ($\Delta Vc$), with respect to the total charge amount of electric charges of supplied toner. More specifically, C (capacitance)$\times\Delta Vc$ (development contrast) represents the total charge amount of electric charges of toner per unit area developable from the developing roller 302 onto the photosensitive drum 201 at the developing NIP portion. The total charge amount of electric charges of toner supplied to the photosensitive drum 201 is determined by the charge amount of electric charges per unit area on the developing roller 302, Q/S, and the peripheral speed ratio with respect to the photosensitive drum 201, $\Delta v$. Thus, the total charge amount is represented by the product of Q/S and $\Delta v$ ($Q/S\times\Delta v$).

As described above, the toner amount developable by the development contrast is represented by a formula Q/S (charge amount)$\times\Delta v$ (peripheral speed ratio)=C (capacitance)$\times\Delta Vc$ (development contrast). More specifically, in a case where a condition $Q/S\times\Delta v\leq C\times\Delta Vc$ is satisfied, the total charge amount of toner supplied from the developing roller 302 is smaller than the charge amount receivable by the photosensitive drum 201. Accordingly, under this condition, almost all or all the toner on the developing roller 302 is developed onto the photosensitive drum 201.

In actual examination, in a case where $\Delta Vc$ is equal to −200 [V], M/S on the photosensitive drum 201 decreases under a condition $\Delta v=210$ [%]. $Q/S\times\Delta v$ is about $-0.32\times10^{-3}$ ($Q/S=-0.15\times10^{-3}$ $q/m^2$). Based on the above-described result and the relation $Q/S\times\Delta v=C\times\Delta Vc$, the capacitance C of the photosensitive drum$=1.6\times10^{-6}$ [F]. Q/S was measured by using the Model 212HS Charge-to-Mass Ratio System from TREK.

In step S103, the control unit forms an electrostatic latent image for toner detection on the photosensitive drum 201 in the above-described development settings, and develops toner from the developing roller 302 onto the electrostatic latent image to form a detection toner patch. In step S104, the control unit reads the detection toner patch by using the optical sensor 220 to detect the toner amount. In step S105, when detection is completed, the control unit records the detected information in the nonvolatile memory 901. In step S106, the control unit ends the operations of the detection mode for detecting the toner amount on the photosensitive drum 201.

Prediction of the toner amount on the photosensitive drum 201 in the high density mode will be described below. According to the present exemplary embodiment, the peripheral speed ratio in the high density mode is set to 250%, and the peripheral speed ratio in the detection mode is set to 80%. Accordingly, the control unit multiplies the toner amount information obtained in the detection mode for detecting the toner amount on the photosensitive drum 201 by 3.125 (250%/80%) to predict the toner amount per unit area on the photosensitive drum 201 in the high density mode. Practically, the CPU 215 serving as a control unit performs calculation by using the toner amount information recorded in the nonvolatile memory 901. As described above, it becomes possible to predict with high accuracy the toner amount in the high density mode by reducing the peripheral speed ratio between the photosensitive drum 201 and the developing roller 302 and detecting with high accuracy the toner amount per unit area on the photosensitive drum 201. According to the present exemplary embodiment, the peripheral speed ratio is set by changing the rotational speed (drive speed) of the developing roller 302 without changing the rotational speed (drive speed) of the photosensitive drum 201 at the time of normal printing (in the non-high density mode). However, the peripheral speed ratio setting is not limited thereto. The rotational speed of the photosensitive drum 201 may be changed while a constant rotational speed of the developing roller 302 is kept constant. Further, the peripheral speed ratio setting may be changed by changing the rotational speed of both the developing roller 302 and the photosensitive drum 201. The rotational speed (drive speed) of the photosensitive drum 201 at the time of normal printing (in the non-high density mode) is set so that the moving speed of the surface of the photosensitive drum 201 becomes 200 mm/sec. Accordingly, in the present exemplary embodiment, the moving speed of the surface of the developing roller 302 is 160 mm/sec with the 80% peripheral speed ratio, and is 500 mm/sec with the 250% peripheral speed ratio.

The peripheral speed ratio (v11/v12) between the peripheral speed of the developer bearing member (v11) and the peripheral speed of the image bearing member (v12) in the detection mode is denoted by Δv1. The peripheral speed ratio (v21/v22) between the peripheral speed of the developer bearing member (v21) and the peripheral speed of the image bearing member (v22) in the image forming mode is denoted by Δv2. In this case, under a condition Δv1<Δv2, the developer amount on the image bearing member in the image forming mode can be estimated based on a result of the detection of the developer amount on the image bearing member in the detection mode.

(First Comparative Example)

Figure 6:
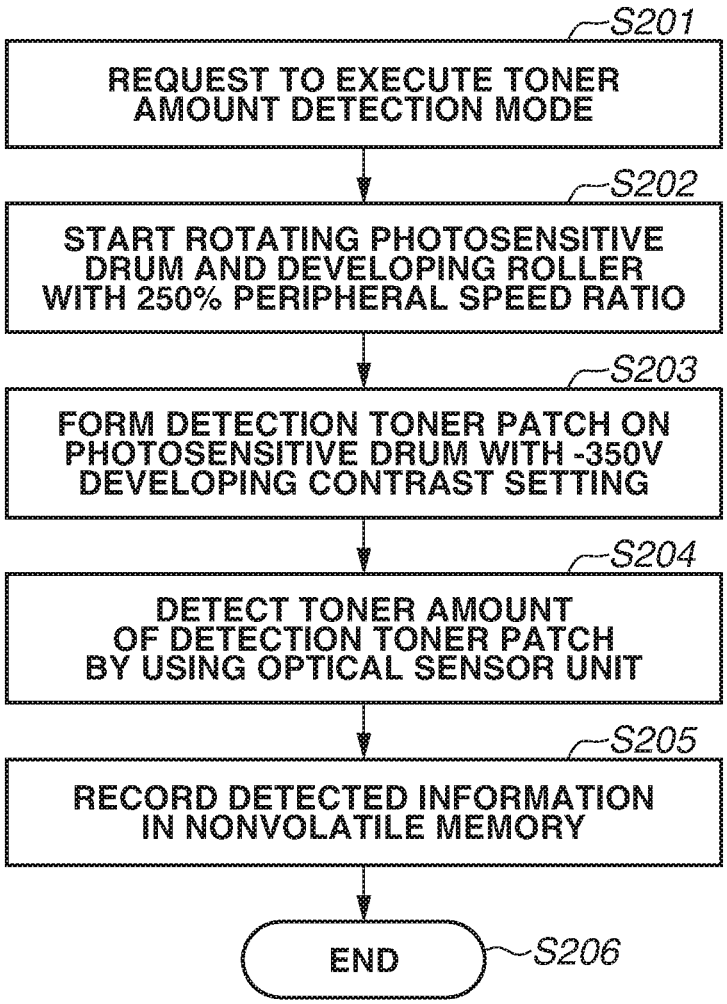
FIG. 6 is a flowchart illustrating a detection mode for detecting the toner amount on a photosensitive drum according to a first comparative example.

Operations in the detection mode in the high density mode in a comparative example will be described below with reference to FIG. 6. In step S201, in a case where a request for executing the detection mode is issued from the engine controller 214, the control unit executes the detection mode. In step S202, in the detection mode in the high density mode, the control unit starts rotating the photosensitive drum 201 and the developing roller 302 with the 250% peripheral speed ratio (=peripheral speed ratio in the high density mode). The development contrast in the detection mode in the high density mode is set to −350V. As in the first exemplary embodiment, almost all of solid black toner portions are set to be developed from the developing roller 302 onto the photosensitive drum 201. As in the first exemplary embodiment, in step S203, the control unit forms a detection toner patch, and in step S204, the detection unit detects the toner amount by using the optical sensor 220. In step S205, when detection is completed, the control unit records the detected information in the nonvolatile memory 901. In step S206, the control unit ends the operations of the detection mode in the high density mode.

<Detection Accuracy Considerations>

In the first exemplary embodiment and the first comparative example, the peripheral speed ratio has been changed for a plurality of times to examine the detection accuracy. As a method for measuring the toner amount, a detection toner patch for detection is prepared by forming an electrostatic latent image on the photosensitive drum 201 Then the toner actually adhered on the photosensitive drum is sampled and measured to determine the toner weight per unit area (kg/m$^2$) on the photosensitive drum 201. And then, through comparison between the measurement result and the detection result, the results with the following indices are evaluated:

A: The difference between the detection result and the measurement result was 0.0005 (kg/m$^2$) or below.

B: The difference between the detection result and the measurement result exceeded 0.0005 (kg/m$^2$).

<Detection Accuracy Results>

Table 2 illustrates a result of the comparison between the detection accuracy (predictive accuracy) according to the comparative example and the detection accuracy according to the present exemplary embodiment, with respect to several peripheral speed ratios. The toner weight per unit area (kg/m$^2$) on the photosensitive drum 201 with the 150% peripheral speed ratio was 0.0043. The toner weight per unit area (kg/m$^2$) on the photosensitive drum 201 with the 200% peripheral speed ratio was 0.0057. The toner weight per unit area (kg/m$^2$) on the photosensitive drum 201 with the 250% peripheral speed ratio was 0.0075.

TABLE 2

Result of peripheral speed ratio and detection accuracy according to first exemplary embodiment and first comparative example

| Peripheral speed ratio | 150% | 200% | 250% |
|---|---|---|---|
| Detection accuracy (first exemplary embodiment) | A | A | A |
| Detection accuracy (first comparative example) | A | B | B |

In the first exemplary embodiment, we obtained favorable detection accuracy over a range of the peripheral speed ratio from 150% to 250%. Even in the high density mode, for example, with the 200% or 250% peripheral speed ratio, the detection unit detected with high accuracy the toner amount per unit area on the photosensitive drum 201 by reducing the peripheral speed ratio between the photosensitive drum 201 and the developing roller 302 in the detection mode. This enabled prediction of the toner amount in the high density mode with high accuracy.

In the first comparative example, when the peripheral speed ratio is 200% or 250% even in the detection mode, three or more toner layers were formed on the photosensitive drum 201 and the detecting accuracy of the optical sensor 220 decreased, resulting in the decrease in the detection accuracy.

In this way, the prediction accuracy in the high density mode can be improved by employing the present exemplary embodiment. According to the present exemplary embodiment, the 80% peripheral speed ratio for approximately one or less layer was used at the time of detection. However, if the peripheral speed ratio can be reduced to a range in which the detection unit can detect the toner amount with sufficient accuracy, by providing a smaller peripheral speed ratio than that at the time of image formation, approximative detection is possible.

According to the present exemplary embodiment, in determining the peripheral speed ratio for obtaining a required density, a required peripheral speed can be predicted with sufficient accuracy based on the toner amount on the developing roller 302. This is because almost all the toner amount on the developing roller 302 is transferred onto the photosensitive drum 201, and the toner amount on the developing roller 302 is maintained approximately constant. As a result, it is not necessary to perform patch detection a plurality of times while the peripheral speed is varied to a plurality of values. The detection time and the toner consumption can be thus reduced, compared with the detection method for performing patch detection a plurality of times while the peripheral speed is varied to a plurality of values.

In the present exemplary embodiment, we have changed the peripheral speed ratio by changing the drive speed of the developing roller 302 because we had confirmed that the toner amount per unit area on the developing roller 302 does not depend on the rotational speed (drive speed). In regulation with the contact-type developing blade 309 in a one-component non-magnetic development method, the toner amount on the developing roller 302 does not depend on the rotational speed (drive speed) in many cases. To detect the toner amount on the photosensitive drum 201 in the high density mode with higher accuracy, some method change the drive speed of the photosensitive drum 201 so as to realize a desired peripheral speed ratio with respect to the drive speed of the developing roller 302 in the high density mode.

The peripheral speed ratio and bias according to the present exemplary embodiment are to be considered as illustrative and not restrictive to the present exemplary embodiment. Although the fixing temperature and image processing have been described above as an example factors for changing printing conditions by using information about the toner amount on the photosensitive drum 201, the information may be fed back to change other setting conditions such as other bias, latent image settings, distance between sheets, and residual toner amount detection.

As described above, according to the first exemplary embodiment, it is possible to predict with high accuracy the toner amount on the photosensitive drum 201 in the high density mode by reducing the peripheral speed ratio between the developing roller 302 and the photosensitive drum 201 and detecting the toner amount on the photosensitive drum 201 with high accuracy.

A second exemplary embodiment of the present invention is described below. In the first exemplary embodiment, the toner amount "on the photosensitive drum 201" is detected by the optical sensor 220 serving as a detection unit.

In the first exemplary embodiment, the optical sensor 220 is disposed to face the photosensitive drum 201 of each image forming station. In the second exemplary embodiment, only one optical sensor 220 is disposed to face the intermediate transfer belt 205 serving as an intermediate transfer member. In other words, the toner amount "on the intermediate transfer member" is detected by the optical sensor 220 serving as a detection unit. According to the present exemplary embodiment, the number of the optical sensors 220 can be reduced, resulting in cost reduction.

Many other elements are duplicated with those in the first exemplary embodiment, and redundant descriptions thereof will be omitted in the second exemplary embodiment.

Figure 7:
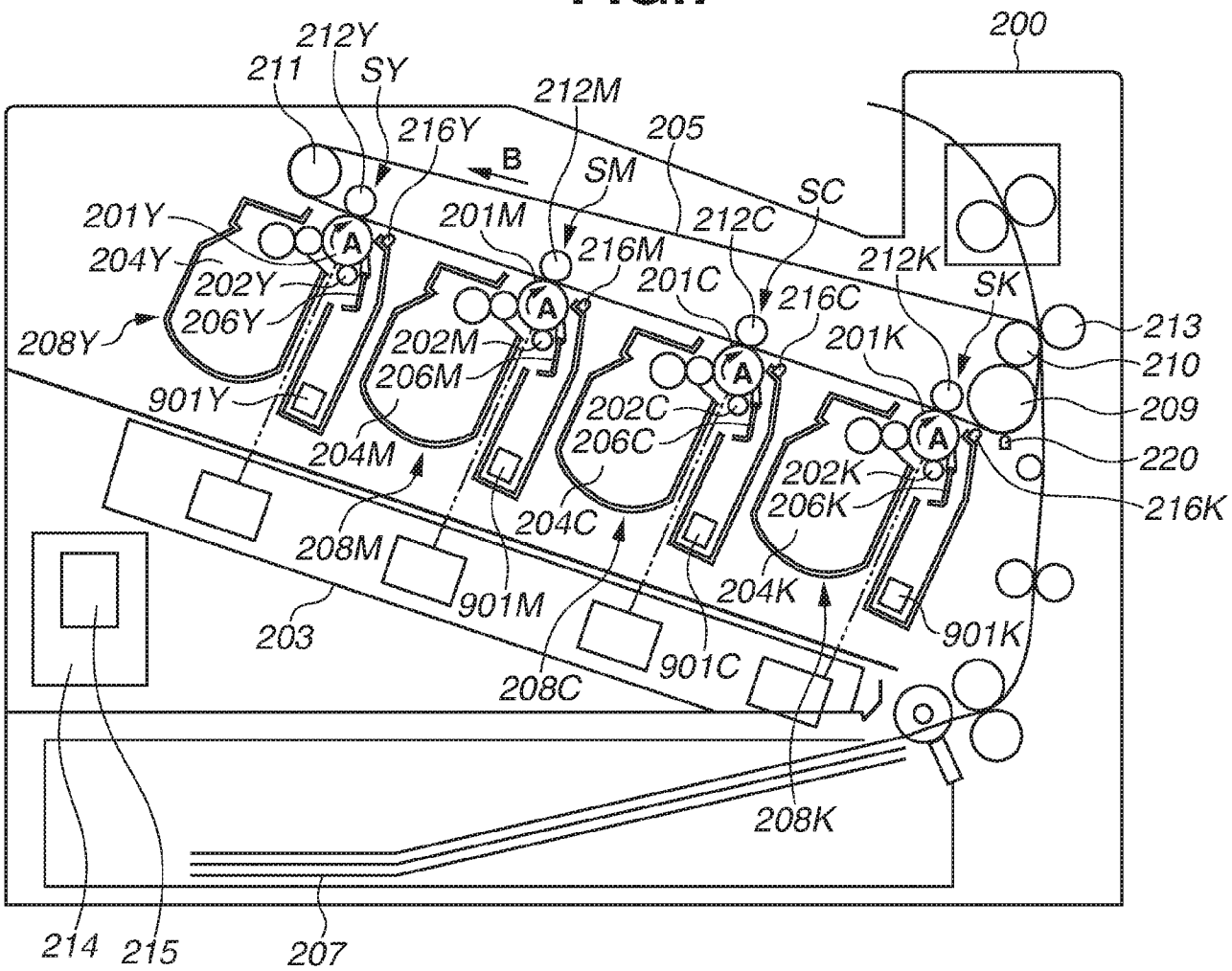
FIG. 7 is a schematic view illustrating an image forming apparatus according to the second exemplary embodiment.

A process cartridge and an image forming apparatus according to the present exemplary embodiment will be described in detail below. FIG. 7 is a sectional view schematically illustrating an image forming apparatus 200 according to the present exemplary embodiment. Each of the image forming stations includes the process cartridge 208 and the primary transfer roller 212 disposed to face the process cartridge 208 via the intermediate transfer belt 205 serving as an intermediate transfer member. According to the present exemplary embodiment, the optical sensor 220 is disposed more on the downstream side of the process cartridge 208 in the moving direction of the intermediate transfer belt 205 and more on the upstream side of the secondary transfer counter roller 210 in the moving direction of the intermediate transfer belt 205.

<Toner Amount Detection Method According to Second Exemplary Embodiment>

A method for detecting the toner amount on the intermediate transfer member in the high density mode according to the second exemplary embodiment will be described below. Printing conditions (image formation conditions) are similar to those according to the first exemplary embodiment and the first comparative example. More specifically, the peripheral speed ratio at the time of normal image formation is set to 150% while the peripheral speed ratio in the high density mode is set to 250%.

In latent image settings, the development contrast at the time of normal image formation is set to −200V, and the development contrast in the high density mode is set to −350V. With this development contrast, almost all the toner is set to be developed from the developing roller 302 onto the photosensitive drum 201.

In the present exemplary embodiment, the control unit first executes a mode for detecting the toner amount per unit area on the intermediate transfer member (hereinafter referred to as a detection mode). The control unit executes this detection mode to predict and detect the toner amount per unit area on the intermediate transfer member in the high density mode. The detection mode according to the present exemplary embodiment will be described below. In the detection mode according to the present exemplary embodiment, the control unit forms a detection patch latent image (with the −200V development contrast) on the photosensitive drum 201, and supplies toner from the developing roller 302 to the latent image with the 80% peripheral speed ratio to form a detection toner patch. The control unit primarily transfers the formed detection toner patch onto the intermediate transfer belt 205 to form a detection toner patch on the intermediate transfer belt 205. The control unit performs detection on the detection toner patch on the intermediate transfer belt 205 by using the optical sensor 220 as a detection unit. With the development contrast of the detection patch latent image, almost all the toner is set to be developed from the developing roller 302 onto the photosensitive drum 201. In this case, the latent image potential of the patch latent image has not yet been filled with electric charges of toner. According to the present exemplary embodiment, the primary transfer efficiency was to 98%. Thus, we assumed that the toner amount was reduced to 96% which is the average value of the primary transfer efficiency in transferring the toner on the photosensitive drum 201 onto the intermediate transfer belt 205. Then, the control unit multiplies information about the detected toner amount on the intermediate transfer belt 205 by the reciprocal of the transfer efficiency to estimate the toner amount on the photosensitive drum 201, and obtains information about the toner amount per unit area on the developing roller 302. The control unit then predicts the toner amount on the photosensitive drum 201 in the high density mode based on the information about the toner amount on the developing roller 302 by using a similar method to that according to the first exemplary embodiment. Table 3 illustrates a result of the detection accuracy with respect to several peripheral speed ratios.

TABLE 3

Result of peripheral speed ratio and detection accuracy according to first comparative example and second exemplary embodiment

| Peripheral speed ratio | 150% | 200% | 250% |
|---|---|---|---|
| Detection accuracy (first comparative example) | A | B | B |
| Detection accuracy (second exemplary embodiment) | A | A | A |

Table 3 indicates that the use of the present exemplary embodiment can improve the predictive accuracy with the large peripheral speed ratio. In addition, since the number of the optical sensors 220 can be reduced from four in the first exemplary embodiment to one, the cost and the main body space can be reduced.

The peripheral speed ratio and bias according to the present exemplary embodiment are to be considered as illustrative and not restrictive to the present exemplary embodiment. An example of changing printing conditions (image formation conditions) by using information about the toner amount per unit area on the intermediate transfer member will be described below. There are such setting conditions as development and charging biases, latent images, distance between sheets, and residual toner amount detection.

As described above, it is possible to predict with high accuracy the toner amount on the photosensitive drum 201 in the high density mode by reducing the peripheral speed ratio between the photosensitive drum 201 and the developing roller 302 and detecting the toner amount on the intermediate transfer belt 205 with high accuracy.

More specifically, also in the present exemplary embodiment, the peripheral speed ratio (v11/v12) between the peripheral speed of the developer bearing member (v11) and the peripheral speed of the image bearing member (v12) in the detection mode is denoted by Δv1, and the peripheral speed ratio (v21/v22) between the peripheral speed of the developer bearing member (v21) and the peripheral speed of the image bearing member (v22) in the image forming mode is denoted by Δv2. In this case, under a condition Δv1<Δv2, the control unit can estimate the developer amount on the intermediate transfer member in the image forming mode based on a result of the detection of the developer amount on the image bearing member in the detection mode. The control unit can also predict the developer amount on the image bearing member based on an estimated value of the developer amount on the intermediate transfer member in the image forming mode.

(Other Embodiments)

In the above-described exemplary embodiments, the peripheral speed ratio in the detection mode is different from the peripheral speed ratio in the image forming mode. However, in a case where a plurality of image forming modes is provided, the peripheral speed ratio in one of the image forming modes may be identical to the peripheral speed ratio in the detection mode. For example, in a case where two different image forming modes (a first and a second image forming mode) are provided, the following setting is also possible: 250% peripheral speed ratio in the first image forming mode (Δv2), 80% peripheral speed ratio in the second image forming mode (Δv3), and 80% peripheral speed ratio in the detection mode (Δv1). In this case, relations Δv3<Δv2 and Δv1=Δv3 are satisfied.

The image forming mode further includes the first and second image forming modes. The peripheral speed ratio (v21/v22) between the peripheral speed of the developer bearing member (v21) and the peripheral speed of the image bearing member (v22) in the first image forming mode is denoted by Δv2. The peripheral speed ratio (v31/v32) between the peripheral speed of the developer bearing member (v31) and the peripheral speed of the image bearing member (v32) in the second image forming mode is denoted by Δv3. In such a case, relations Δv3<Δv2 and Δv1=Δv3 are satisfied.

Although, in the above-described exemplary embodiments, an optical sensor of normal reflection type is used, an optical sensor of diffused reflection type is also usable depending on a configuration. Light from a light source, with which the density patch is irradiated, is scattered in all directions as scattering light, and an optical sensor of diffused reflection type detects the scattering light. Accordingly, it is necessary to take into consideration the fact that the reflectance changes with the spectrum sensitivity of toner because of weak reflected light.

Figure 3:
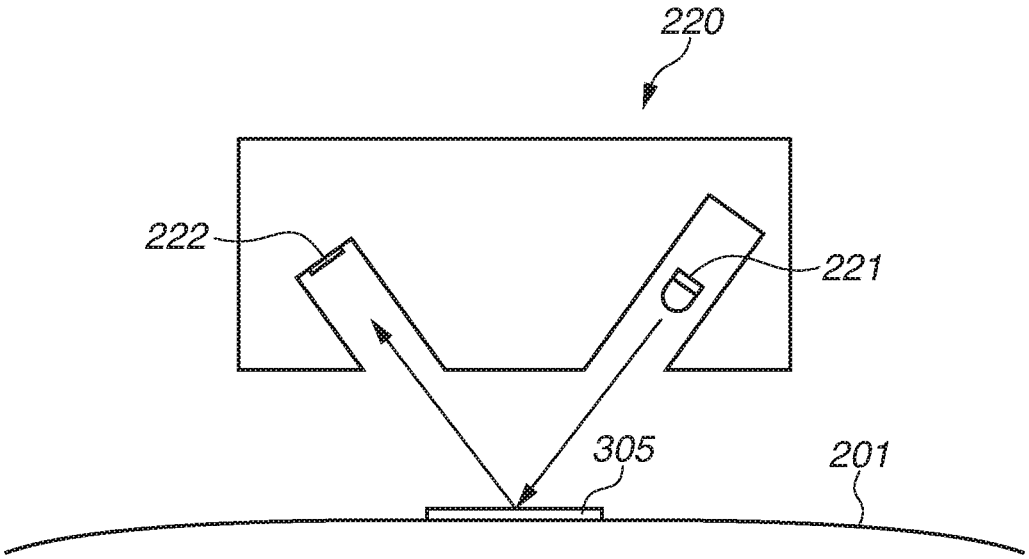
FIG. 3 is a schematic view illustrating an optical sensor unit according to the first and the second exemplary embodiments.
Figure 4:
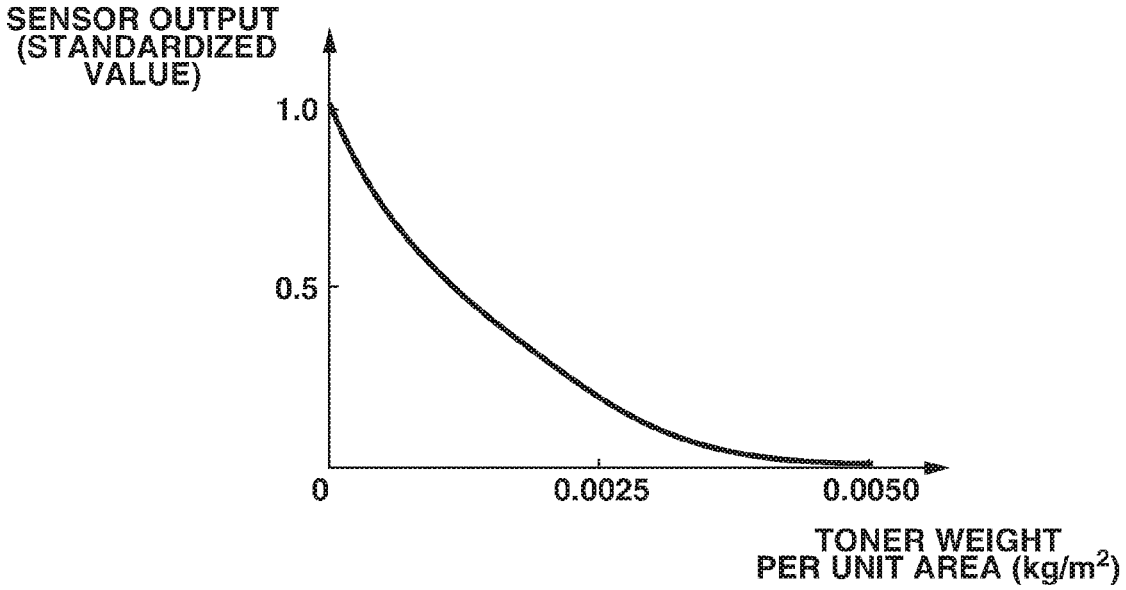
FIG. 4 illustrates a relation between an output from the optical sensor unit and a toner amount according to the first and the second exemplary embodiments.

By contrast, as illustrated in FIG. 3, the above-described optical sensor 220 of normal reflection type detects specular reflected light with which the angle formed by the target surface and the optical axis of density patch irradiation light from a LED as a light source equals the angle formed by the target surface and the optical axis of reflected light. In detecting normal reflection light, the optical sensor 220 detects the toner amount based on the decrease in the light amount due to the specular reflected light from the target surface being hidden by toner. Thus, normal reflection light detection is characterized in that the spectrum sensitivity of toner is irrelevant and that the absolute value of light intensity is high. Accordingly, we found that, in a state where two or more toner layers were formed, the specular reflected light weakened, resulting in the degraded detection accuracy.

Although the above-described exemplary embodiments have been described on the premise that all the toner on the developing roller 302 is transferred onto the photosensitive drum 201, the apparatus configuration is not limited thereto. The present invention is applicable as long as the peripheral speed ratio is changed so that the toner amount per unit area can be detected by a detection unit.

As described above, according to the present invention, it becomes possible to detect the developer amount with sufficient accuracy by changing the peripheral speed ratio to change the developer amount per unit area.

According to the present invention, it becomes possible to detect the developer amount with sufficient accuracy by changing the peripheral speed ratio to change the developer amount per unit area on the image bearing member or the intermediate transfer member. In addition, the transfer belt 205 is an optional component in this invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-028396, filed Feb. 17, 2016, and No. 2017-004659, filed Jan. 13, 2017, which are hereby incorporated by reference herein in their entirety.

What is claimed is:

1. An image forming apparatus comprising:

an image bearing member configured to bear a developer image;

a developer bearing member configured to bear developer; and a detection unit configured to detect a developer amount on the image bearing member;

wherein, in an image forming mode, the developer image is formed on the image bearing member based on developer from the developer bearing member to the image bearing member and in a detection mode, a detection developer image used for detection is formed on the image bearing member and a developer amount of the detection developer image is detected by the detection unit, wherein, in a case where a peripheral speed ratio (v11/v12) between a peripheral speed (v11) of the developer bearing member and a peripheral speed (v12) of a photosensitive member in the detection mode is denoted by $\Delta v1$, and a peripheral speed ratio (v21/v22) between a peripheral speed (v21) of the developer bearing member and a peripheral speed (v22) of the photosensitive member in the image forming mode is denoted by $\Delta v2$, in a state of $\Delta v1<\Delta v2$, a developer amount on the image bearing member in the image forming mode is estimated based on a result of a detection of a developer amount on the image bearing member in the detection mode, wherein $(Q/S)\times\Delta v1\leq C\times\Delta Vc$ is satisfied in the detection mode, where a capacitance of the photosensitive member is denoted by C, a development contrast formed by a light portion potential of the photosensitive member and a development potential of the developer bearing member is denoted by $\Delta Vc$, and a charge amount per unit area of developer borne by the developer bearing member is denoted by Q/S.

2. The image forming apparatus according to claim 1, wherein the detection unit includes an optical sensor unit for receiving normal reflection light.

3. The image forming apparatus according to claim 1, wherein the $\Delta v1$ is set so that a developer amount of a developer image per unit area on the image bearing member theoretically forms one layer at most.

4. The image forming apparatus according to claim 1, wherein the image forming mode includes a first image forming mode and a second image forming mode, and wherein $\Delta v3<\Delta v2$ is satisfied, where a peripheral speed of the developer bearing member in the first image forming mode is denoted by v21, a peripheral speed of the photosensitive member is denoted by v22, a peripheral speed ratio (v21/v22) between the peripheral speed (v21) of the developer bearing member and the peripheral speed (v22) of the photosensitive member is denoted by $\Delta v2$, and a peripheral speed ratio (v31/v32) between a peripheral speed (v31) of the developer bearing member and a peripheral speed (v32) of the photosensitive member in the second image forming mode is denoted by $\Delta v3$.

5. The image forming apparatus according to claim 4, wherein $\Delta v1=\Delta v3$ is satisfied in the image forming mode.

6. The image forming apparatus according to claim 1, further comprising a process cartridge including the photosensitive member and the developer bearing member, the process cartridge configured to be attachable to the image forming apparatus, wherein, based on a signal detected by the detection unit before a first image forming operation is performed after the process cartridge is attached to a main body of the image forming apparatus, a signal detected in the detection mode is corrected.

7. The image forming apparatus according to claim 1, further comprising a control unit configured to be capable of executing the image forming mode and the detection mode.

8. An image forming apparatus comprising:

an image bearing member configured to bear a developer image;

a developer bearing member configured to bear developer; and a detection unit configured to detect a developer amount on the image bearing member;

wherein, in an image forming mode, the developer image is formed on the image bearing member based on developer from the developer bearing member to the image bearing member and in a detection mode, a detection developer image used for detection is formed on the image bearing member and a developer amount of the detection developer image is detected by the detection unit, wherein, in a case where a peripheral speed ratio (v11/v12) between a peripheral speed (v11) of the developer bearing member and a peripheral speed (v12) of a photosensitive member in the detection mode is denoted by $\Delta v1$, and a peripheral speed ratio (v21/v22) between a peripheral speed (v21) of the developer bearing member and a peripheral speed (v22) of the photosensitive member in the image forming mode is denoted by $\Delta v2$, in a state of $\Delta v1<\Delta v2$, a developer amount on the image bearing member in the image forming mode is estimated based on a result of a detection of a developer amount on the image bearing member in the detection mode, wherein $\Delta v1<(4/3\times R\times\rho\times H)/G$ is satisfied in the detection mode, where a weight per unit area of developer borne by the developer bearing member in the detection mode is denoted by G, an average radius of the developer is denoted by R, a specific gravity of the developer is denoted by $\rho$, and a planar closest-packing area ratio is denoted by H.

9. The image forming apparatus according to claim 8, wherein $\Delta v2>(4/3\times R\times\rho\times H)/G$ is satisfied in the image forming mode.

* * * * *